US007563997B2

(12) United States Patent
Chou

(10) Patent No.: US 7,563,997 B2
(45) Date of Patent: Jul. 21, 2009

(54) ROLLING-BALL SWITCH AND METHOD OF MAKING THE SAME

(76) Inventor: Tien-Ming Chou, No. 31, San-Hsi 5th St., Taichung City (TW)

( * ) Notice: Subject to any disclaimer, the term of this patent is extended or adjusted under 35 U.S.C. 154(b) by 293 days.

(21) Appl. No.: 11/692,039

(22) Filed: Mar. 27, 2007

(65) Prior Publication Data

US 2008/0237004 A1 Oct. 2, 2008

(51) Int. Cl.
*H01H 35/14* (2006.01)

(52) U.S. Cl. ..... 200/61.45 R; 200/61.52

(58) Field of Classification Search ..... 200/61.45 R, 200/61.46, 61.47, 61.48, 61.5, 61.52, 292; 340/429, 546, 565, 566
See application file for complete search history.

(56) References Cited

U.S. PATENT DOCUMENTS 5,136,127 A * 8/1992 Blair ..... 200/61.52
6,115,929 A * 9/2000 Tanazawa et al. ..... 33/366.24
6,448,516 B1 * 9/2002 Chiang ..... 200/61.45 R
6,518,523 B1 * 2/2003 Chou ..... 200/61.52
6,690,457 B2 * 2/2004 Yamaguchi ..... 356/139.1
6,784,386 B2 * 8/2004 Chou et al. ..... 200/61.51
7,067,748 B1 * 6/2006 Kelley et al. ..... 200/61.45 R
7,230,193 B2 * 6/2007 Chou ..... 200/61.45 R

* cited by examiner

*Primary Examiner*—Elvin G Enad
*Assistant Examiner*—Marina Fishman
(74) *Attorney, Agent, or Firm*—Sheridan Ross P.C.

(57) ABSTRACT

A rolling-ball switch includes an insulative casing part having first and second connecting faces and an intermediate through hole, insulative first and second covering parts each having a recessed inner side that covers the respective connecting face, and two metal plates respectively disposed between the first covering part and the first connecting face and between the second covering part and the second connecting face. The first and second recessed inner sides and the intermediate through hole cooperatively define a chamber. Each metal plate includes an inner peripheral edge having an edge portion projecting into the chamber. A conductive ball is disposed movably in the chamber, and has a diameter larger than a distance between the edge portions of the metal plates so that the conductive ball can bridge the edge portions of the metal plates to place the rolling-ball switch in an ON state.

8 Claims, 12 Drawing Sheets

ROLLING-BALL SWITCH AND METHOD OF MAKING THE SAME

BACKGROUND OF THE INVENTION

1. Field of the Invention

The invention relates to a rolling-ball switch, more particularly to a rolling-ball switch that is easy to assemble and to a method of making the same.

2. Description of the Related Art

Referring to FIG. 1, a conventional rolling-ball switch 10, as disclosed by the applicant in Taiwanese Patent No. 155965, includes an insulated cover body 11, a conductive ball 12 disposed in the cover body 11, four terminal rods 13, and an insulated bottom seat 14. The insulated cover body 11 is made of plastic, and has a hollow rectangular shape. The cover body 11 has a bottom opening 111, and two opposite inward protrusions 112 projecting from an inner wall of the cover body 11 adjacent to the bottom opening 111. The insulated bottom seat 14 is made of plastic, and has four spaced-apart through holes 141, and two opposite grooves 142 (only one is visible) provided on an outer face of the bottom seat 14 to engage the protrusions 112, respectively. Each of the terminal rods 13 has opposite first and second tapered ends 131, 132. The width of each terminal rod 13 is larger than a diameter of a respective one of the through holes 141.

To assemble the conventional rolling-ball switch 10, the conductive ball 12 is initially disposed inside the cover body 11, and the terminal rods 13 are subsequently inserted into the respective through holes 141. The bottom seat 14 is then inserted into the cover body 11 through the bottom opening 111 so as to confine movement of the conductive ball 12 within a receiving space 15 defined by the cover body 11 and the bottom seat 14. At this time, the protrusions 112 and the grooves 142 are respectively engaged to each other, and the conductive ball 12 is movable toward or away from the first tapered ends 131 of the terminal rods 13. Finally, an epoxy resin 114 is filled within a space 113 defined by a bottom end wall of the cover body 11 and a bottom surface of the bottom seat 14.

The conventional rolling-ball switch 10 may be applied to an electrical appliance, such as an electric heater (not shown), that is ideally maintained in an upright state. When the electrical appliance is in use and in an upright state, the conductive ball 12 is in contact with the first tapered ends 131 of the terminal rods 13 so as to maintain the electrical appliance in an ON state. When the electrical appliance is tipped to one side or completely tipped over due to an external force, the conductive ball 12 rolls away from the first tapered ends 131 of the terminal rods 13 so as to switch the electrical appliance to an OFF state. Hence, safe use of the electrical appliance is enhanced.

Although the aforementioned conventional rolling-ball switch 10 can achieve its intended purpose, it has the following drawbacks:

1. To ensure optimum quality of the conventional rolling-ball switch 10, the conductive ball 12 must contact the first tapered end 131 of each terminal rod 13 at a similar angle, that is, the heights of the first tapered ends 131 of the terminal rods 13 must be equal. Because each terminal rod 13 is configured as a separate, individual body, ensuring that the first tapered ends 131 of the terminal rods 13 have equal heights after insertion into the respective through holes 141 complicates the steps of assembly of the conventional rolling-ball switch 10. As a result, the assembly of the conventional rolling-ball switch 10 is time-consuming.

2. With reference to FIG. 3, even when care is taken during assembly, the first tapered ends 131 of the terminal rods 13 are nevertheless not equal in height and have a height difference (I). If the switch 10 tilts rightwards, the conductive ball 12 will move rightwards and away from the left terminal rod 13. If the switch 10 tilts leftwards, the conductive ball 12 will move leftwards and away from the right terminal rod 13. Because the left and right terminal rods 13 are different in height, however, the tilting angle of the switch 10 that causes the conductive ball 12 to move away from the left terminal rod 13 will be different from the tilting angle that causes the conductive ball 12 to move away from the right terminal rod 13. Therefore, the movement of the conductive ball 12 is not uniform when the switch 10 is subjected to external forces so that the ON/OFF operations of the switch 10 become less stable and imprecise.

SUMMARY OF THE INVENTION

Therefore, the object of the present invention is to provide a rolling-ball switch that is capable of overcoming the aforementioned drawbacks of the prior art.

According to one aspect of this invention, a rolling-ball switch comprises an insulative casing part, insulative first and second covering parts, two metal plates, and a conductive ball. The insulative casing part includes a first connecting face, a second connecting face opposite to the first connecting face, and an intermediate through hole extending from the first connecting face to the second connecting face. The insulative first covering part has a first recessed inner side covering the first connecting face. The insulative second covering part has a second recessed inner side covering the second connecting face. The first and second recessed inner sides and the intermediate through hole cooperatively define a chamber. The metal plates are respectively disposed between the first covering part and the first connecting face and between the second covering part and the second connecting face. Each of the metal plates includes an outer peripheral edge, and an inner peripheral edge surrounded by the outer peripheral edge and defining a through hole that communicates with the intermediate through hole. The inner peripheral edge has an edge portion projecting into the chamber. The conductive ball is disposed movably in the chamber, and has a diameter larger than a distance between the edge portions of the metal plates so that the conductive ball can bridge the edge portions of the metal plates to place the rolling-ball switch in an ON state.

According to another aspect of this invention, a method for making the rolling-ball switch of the present invention comprises the steps of: (A) molding a first covering part from plastic; (B) molding a second covering part from plastic; (C) molding a casing part from plastic; (D) stamping two metal plates each having a through hole; and (E) assembling automatically the first and second covering parts, the casing part, the metal plates, and a conductive ball using a machine in such a manner that the first covering part, one of the metal plates, the casing part, the other one of the metal plates, and the second covering part are assembled consecutively and are aligned with each other along an axis. The conductive ball is confined within a chamber defined by the first covering part, the casing part, and the second covering part.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
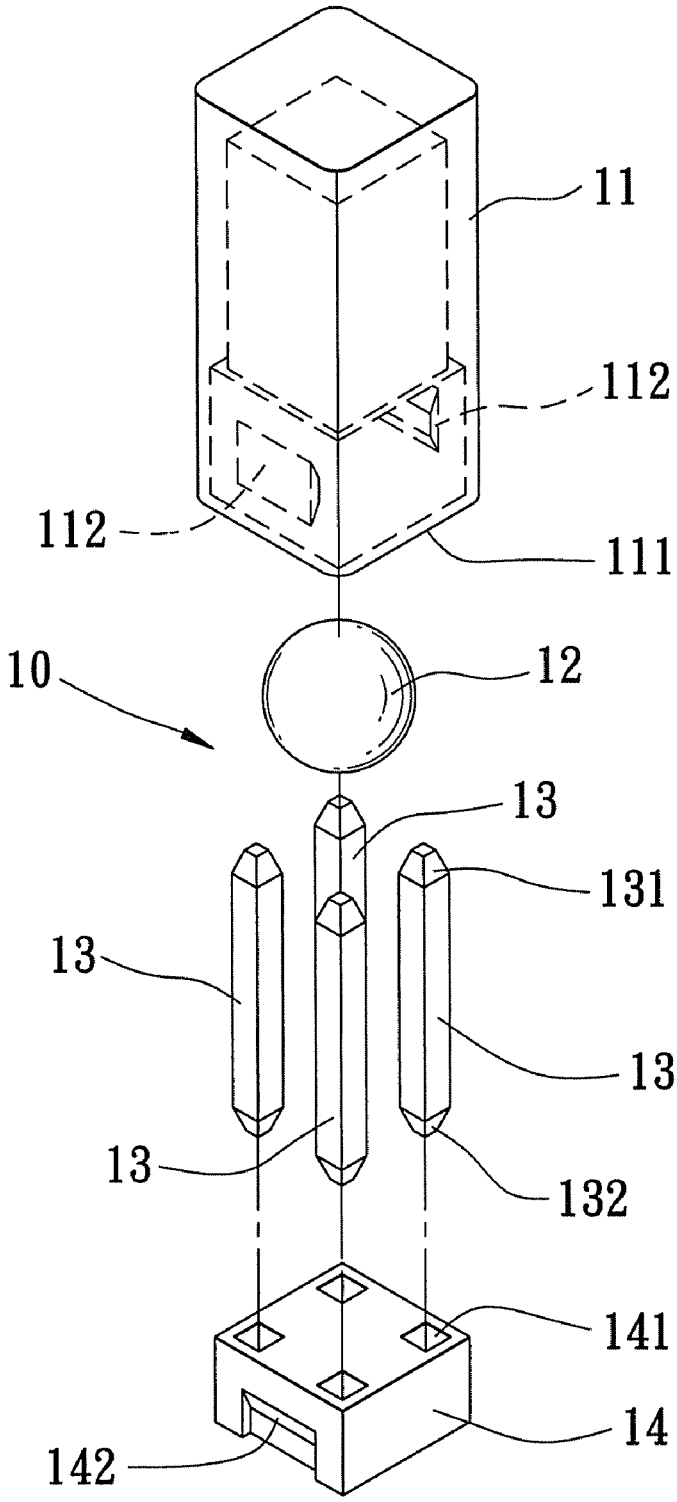
FIG. 1 PRIOR ART
FIG. 1 is an exploded perspective view of a conventional rolling-ball switch disclosed in Taiwanese Patent No. 155965.

Before the present invention is described in greater detail, it should be noted that the same reference numerals have been used to denote like elements throughout the specification.

Referring to FIGS. 4 to 9, the first preferred embodiment of a rolling-ball switch 2 according to the present invention is shown to comprise an insulative casing part 5, an insulative first covering part 3, an insulative second covering part 4, two metal plates 6, and a conductive ball 7.

The insulative casing part 5 is made of plastic, and includes a first connecting face 51, a second connecting face 52 opposite to the first connecting face 51, an intermediate through hole 53 extending from the first connecting face 51 to the second connecting face 52, two spaced-apart first grooves 54 (see FIG. 7) formed in the first connecting face 51, two spaced-apart second grooves 54' formed in the second connecting face 52 and respectively aligned with the first grooves 54, two spaced-apart first protrusions 55 projecting outwardly and axially from the first connecting face 51, and two spaced-apart second protrusions 55' projecting outwardly and axially from the second connecting face 52 and respectively aligned with the first protrusions 55.

The insulative first covering part 3 is made of plastic, and has a substantially square configuration. The first covering part 3 has a first recessed inner side 31 covering the first connecting face 51, two spaced-apart third grooves 32 formed in the first recessed inner side 31 to receive the respective first protrusions 55, and two spaced-apart third protrusions 33 projecting outwardly and axially from the first recessed inner side 31 to engage the first grooves 54.

The insulative second covering part 4 is made of plastic, and has a structure similar to that of the first covering part 3, i.e., the second covering part 4 has a second recessed inner side 41 (see FIG. 6) covering the second connecting face 52, two spaced-apart fourth grooves 42 formed in the second recessed inner side 41 to receive the second protrusions 55', and two spaced-apart fourth protrusions 43 projecting outwardly and axially from the second recessed inner side 41 to engage the second grooves 54'.

Through engagement of the first and second protrusions 55, 55' with the respective third and fourth grooves 32, 42, and through engagement of the third and fourth protrusions 33, 43 with the respective first and second grooves 54, 54', the first and second covering parts 3, 4 are fixed stably and respectively to the first and second connecting faces 51, 52 of the casing part 5.

The metal plates 6 are made by stamping, and are respectively disposed between the first covering part 3 and the first connecting face 51 of the casing part 5 and between the second covering part 4 and the second connecting face 52 of the casing part 5. Each of the metal plates 6 includes an irregular-shaped outer peripheral edge 62, and an inner peripheral edge 61 surrounded by the outer peripheral edge 62 and defining a through hole 63 that communicates with the intermediate through hole 53. The casing part 5 and the first and second covering parts 3, 4 cooperatively define a chamber 8 after assembly.

The inner peripheral edge 61 of each metal plate 6 has an edge portion 64 projecting into the chamber 8. The edge portion 64 has a notch 640, and two contact points 641 on two sides of the notch 640.

Figure 6:
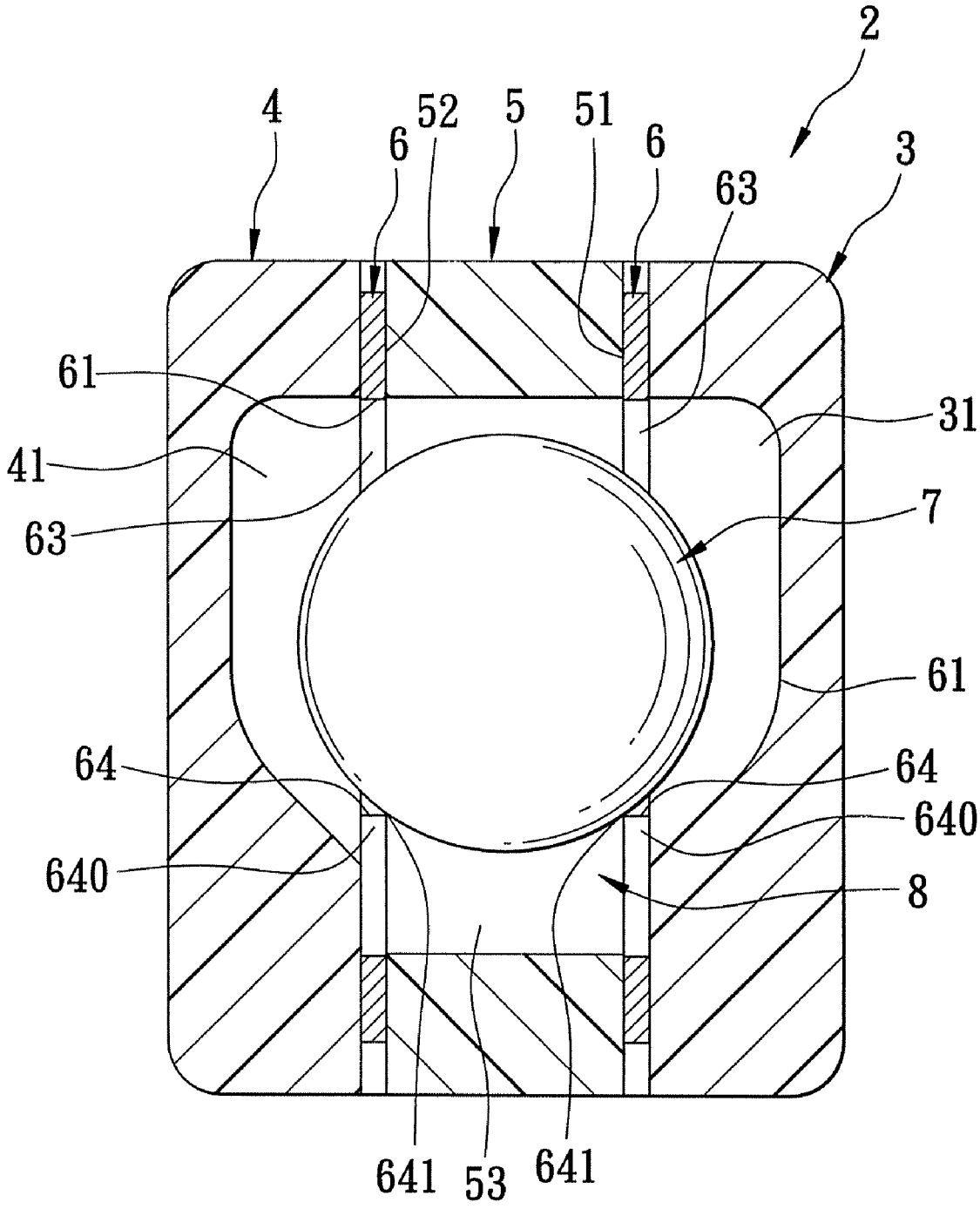
FIG. 6 is a partly sectional view of the first preferred embodiment taken along line VI-VI of FIG. 4.
Figure 7:
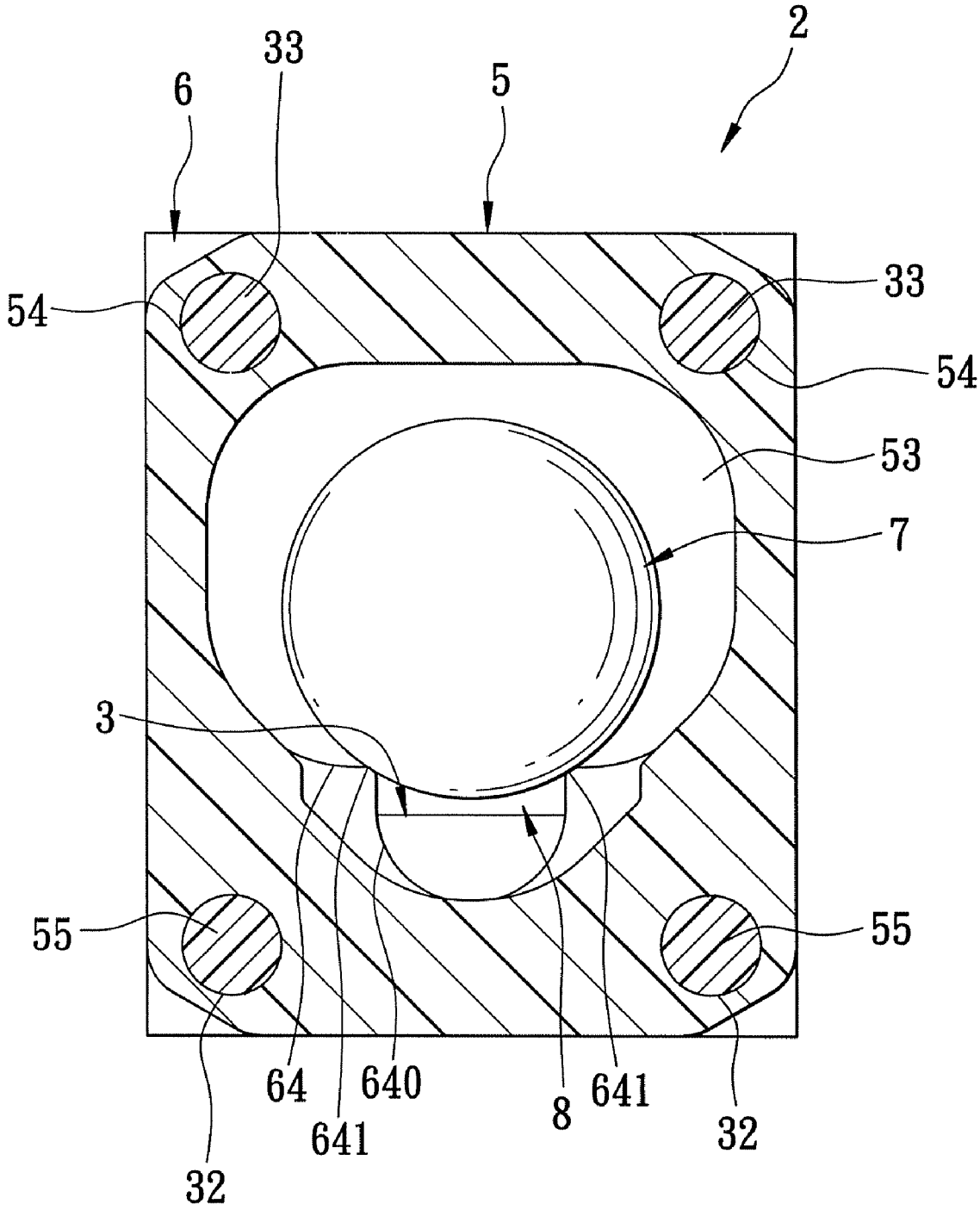
FIG. 7 is a partly sectional view of the first preferred embodiment taken along line VII-VII of FIG. 4.
Figure 8:
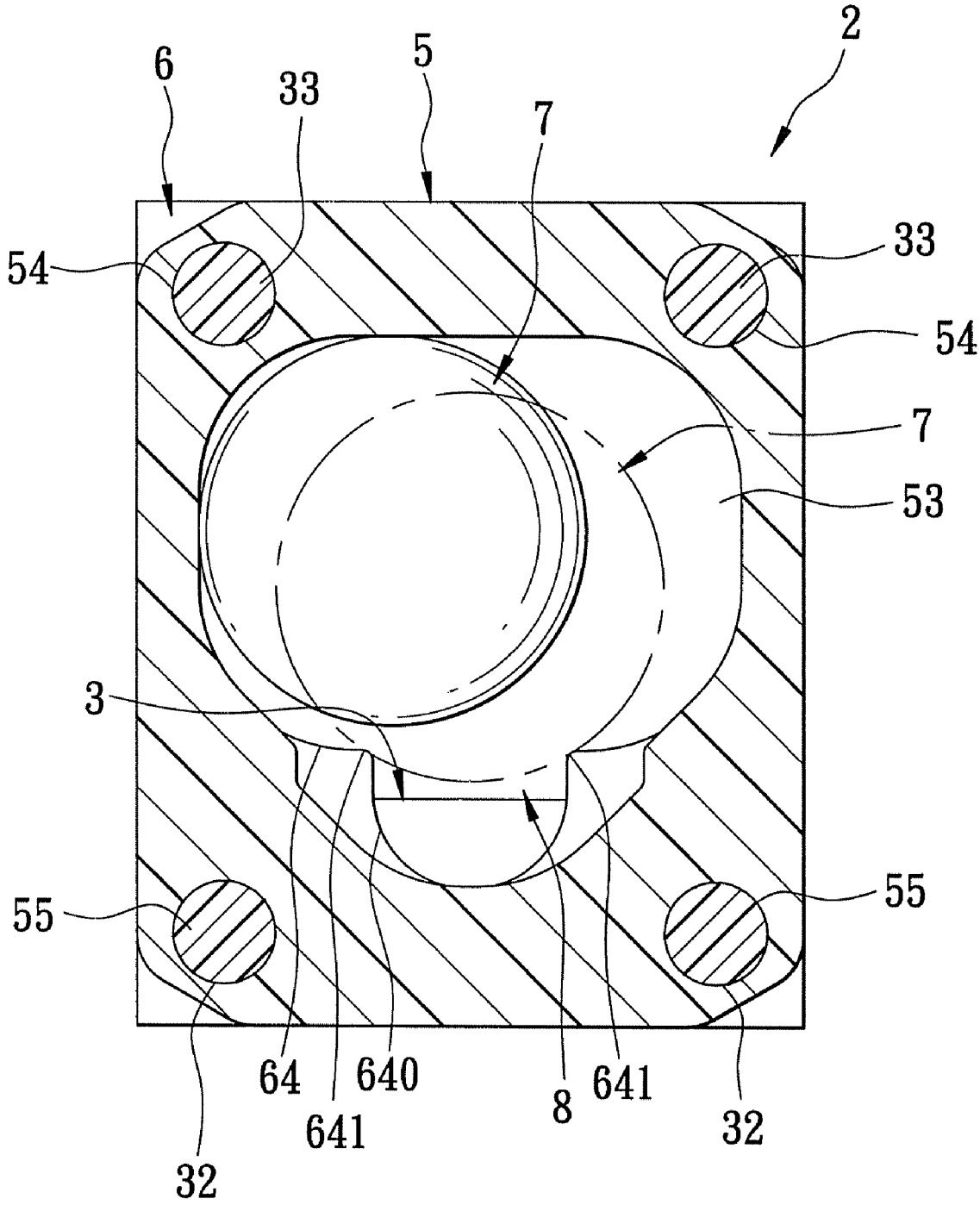
FIG. 8 is a view similar to FIG. 7, but illustrating a conductive ball moving away from edge portions of metal plates to place the rolling-ball switch of the present invention in an OFF state.

The conductive ball 7 is disposed movably in the chamber 8, and has a diameter larger than the distance between the edge portions 64 of the metal plates 6 and the distance between the contact points 641, so that the conductive ball 7 can bridge electrically the contact points 641 of the edge portions 64 of the metal plates 6, and at the same time, be supported by the edge portions 64 of the metal plates 6, so as to place the rolling-ball switch 2 in an ON state, as best shown in FIGS. 6 and 7. When the rolling-ball switch 2 is tilted by an external force, the conductive ball 7 rolls away from the contact points 641 of the metal plates 6 so that electrical connection between the contact points 641 of the metal plates 6 is broken, thereby switching the rolling-ball switch 2 to an OFF state, as best shown in FIG. 8.

Figure 9:
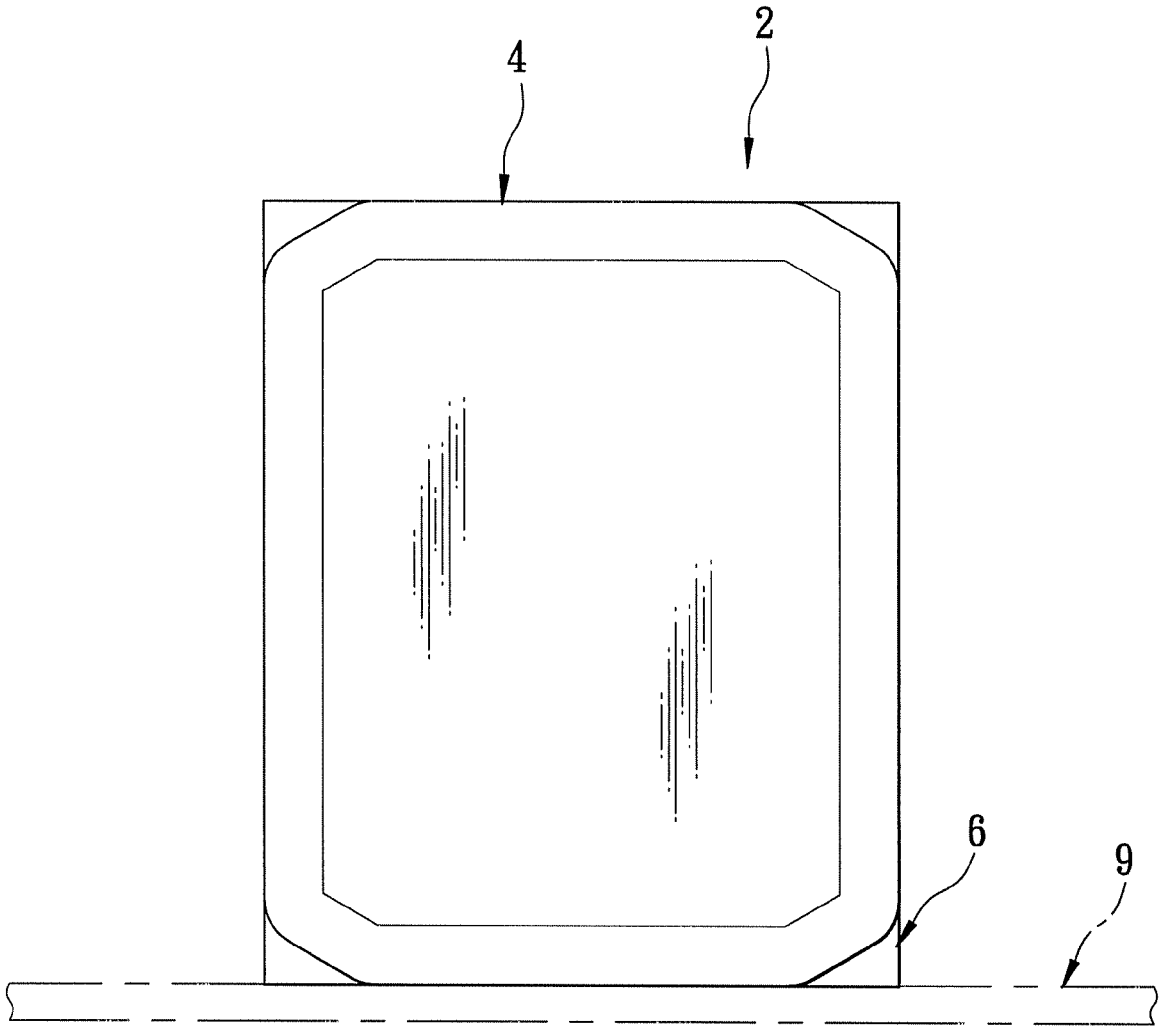
FIG. 9 is a schematic front view of the rolling-ball switch of the first preferred embodiment fixed on a circuit board.

With reference to FIG. 9, the metal plates 6 of the rolling-ball switch 2 may be mounted fixedly on a circuit board 9 using surface mount technology (SMT).

Figure 10:
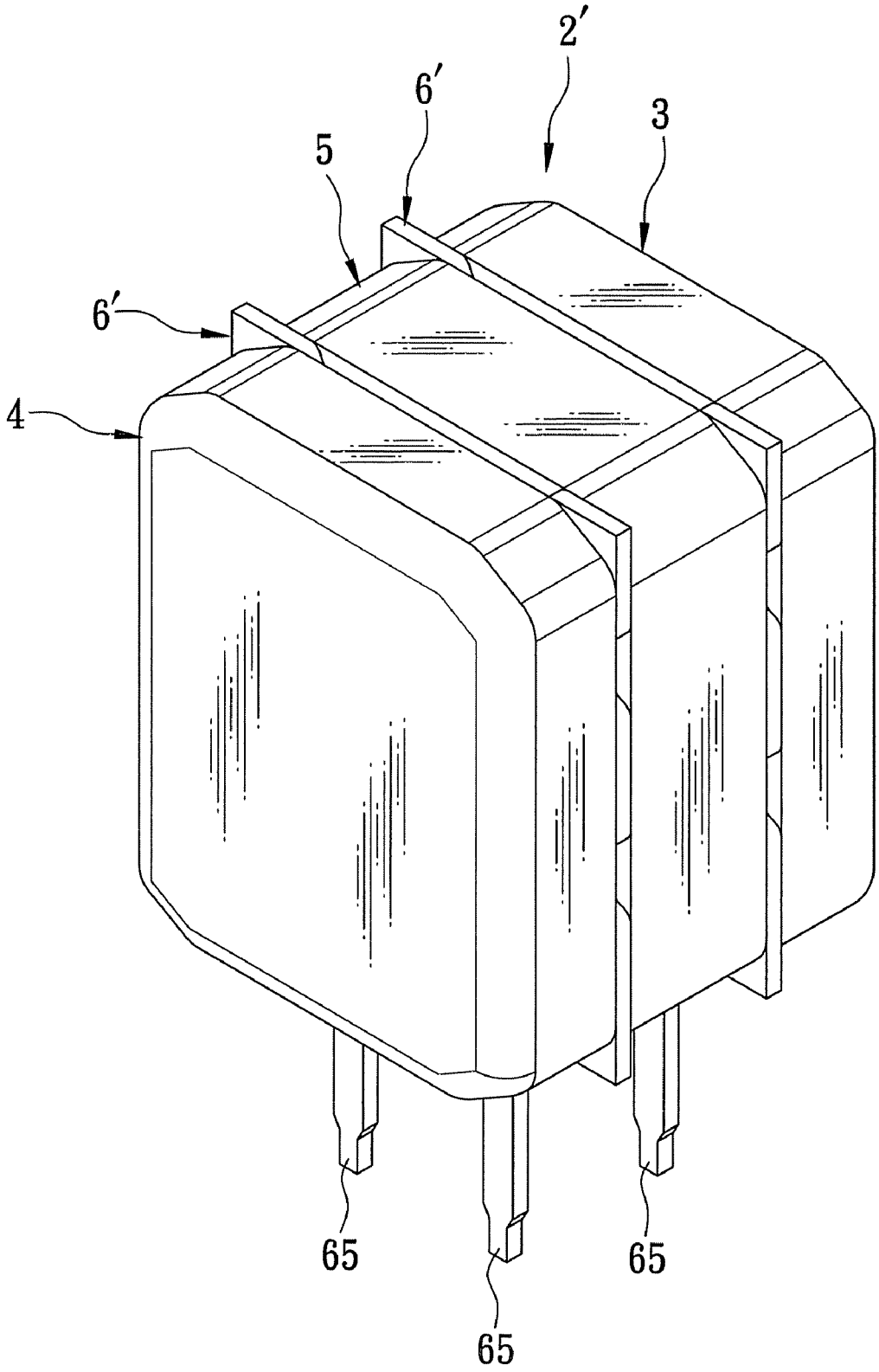
FIG. 10 is a perspective view of a rolling-ball switch according to the second preferred embodiment of the present invention.
Figure 11:
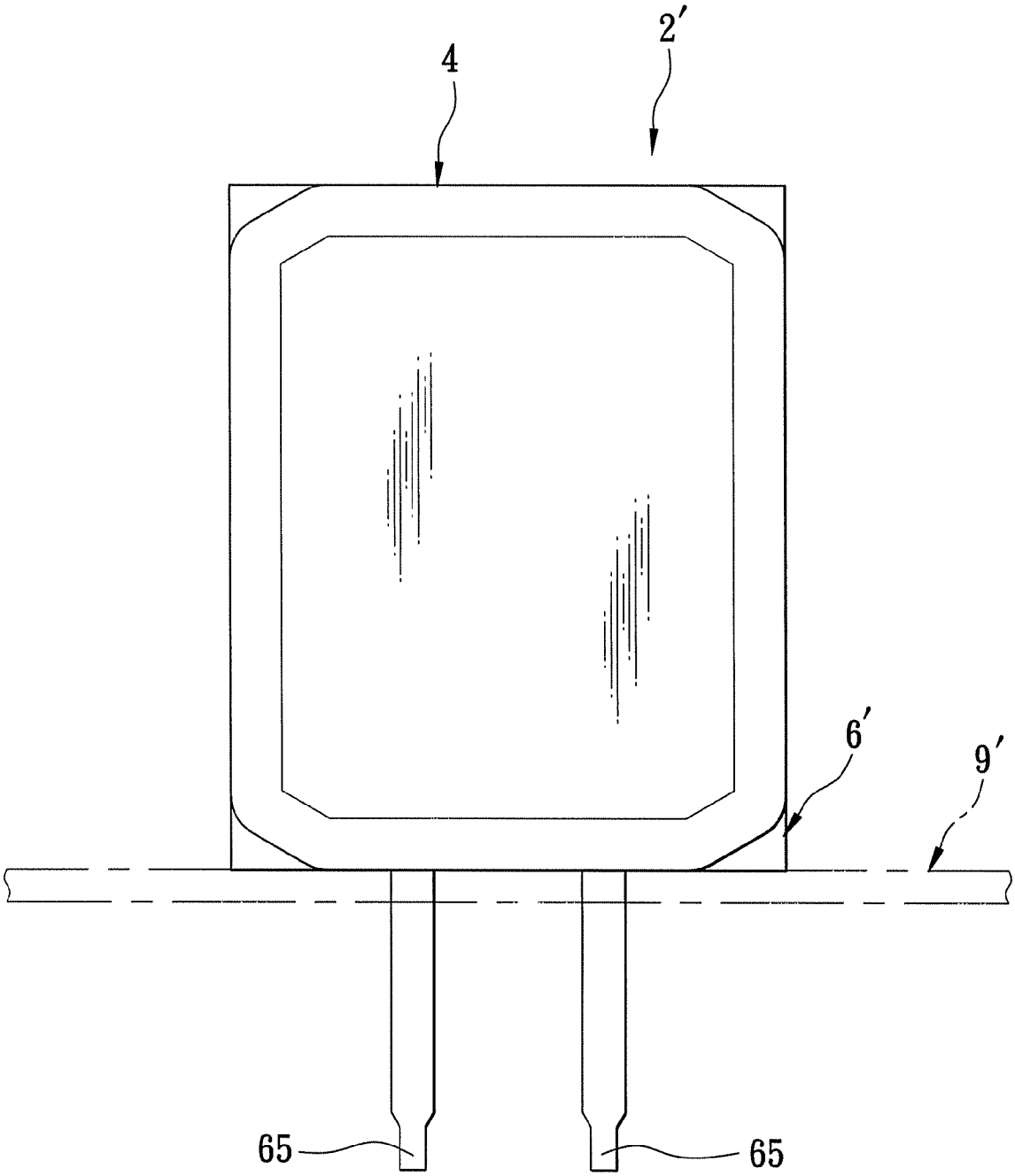
FIG. 11 is a schematic front view of the rolling-ball switch of the second preferred embodiment fixed on a circuit board.

In an alternative embodiment, referring to FIGS. 10 and 11, each of the metal plates 6' of the rolling-ball switch 2' further includes two spaced-apart conductive legs 65 projecting outwardly from the outer peripheral edge 62 (see FIG. 5) of the respective metal plate 6'. The conductive legs 65 are inserted first into a circuit board 9', after which the conductive legs 65 are welded fixedly to the circuit board 9'. As such, the rolling-ball switch 2' can be mounted fixedly on the circuit board 9'.

Figure 4:
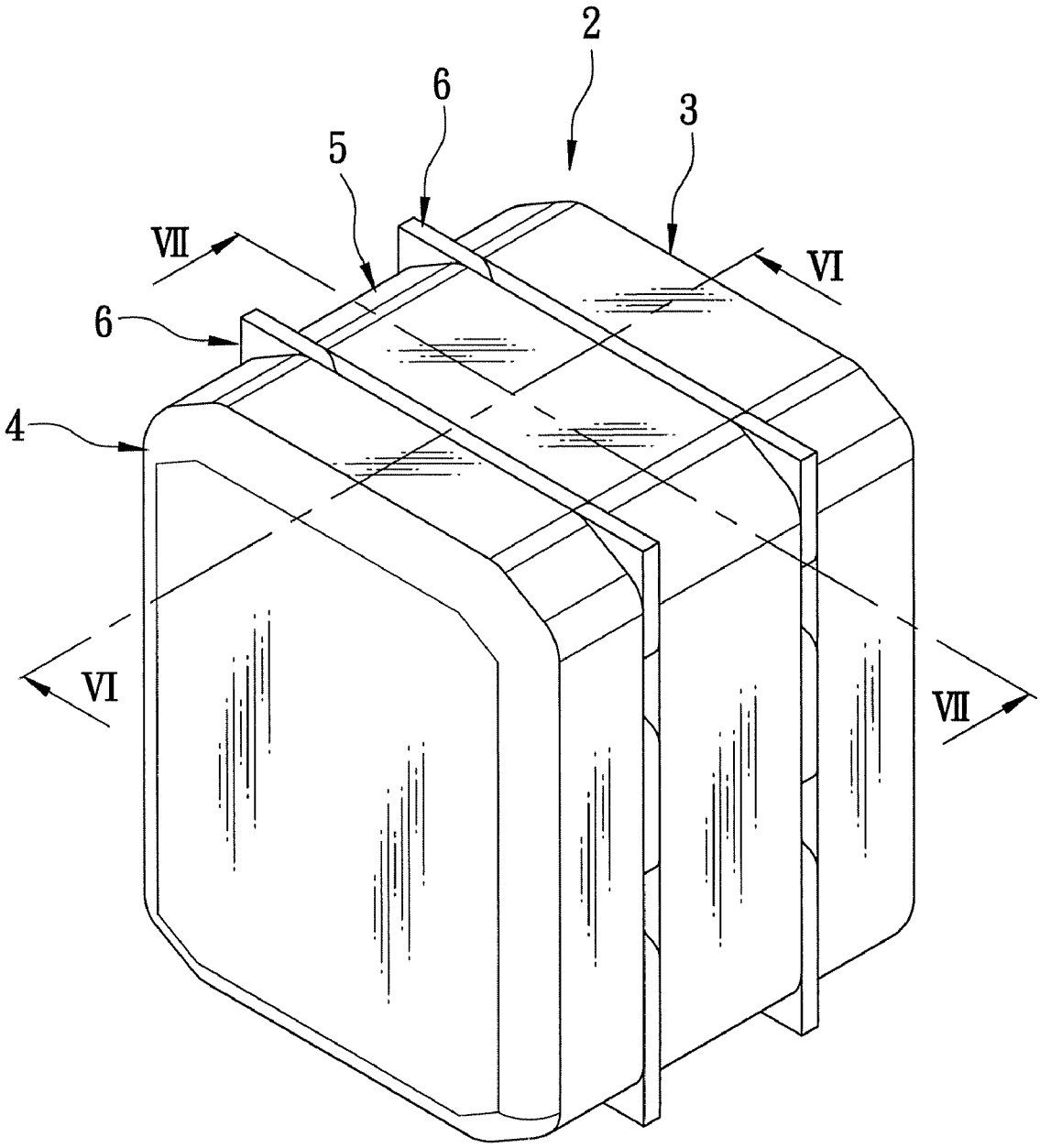
FIG. 4 is a perspective view of the first preferred embodiment of a rolling-ball switch according to the present invention.
Figure 5:
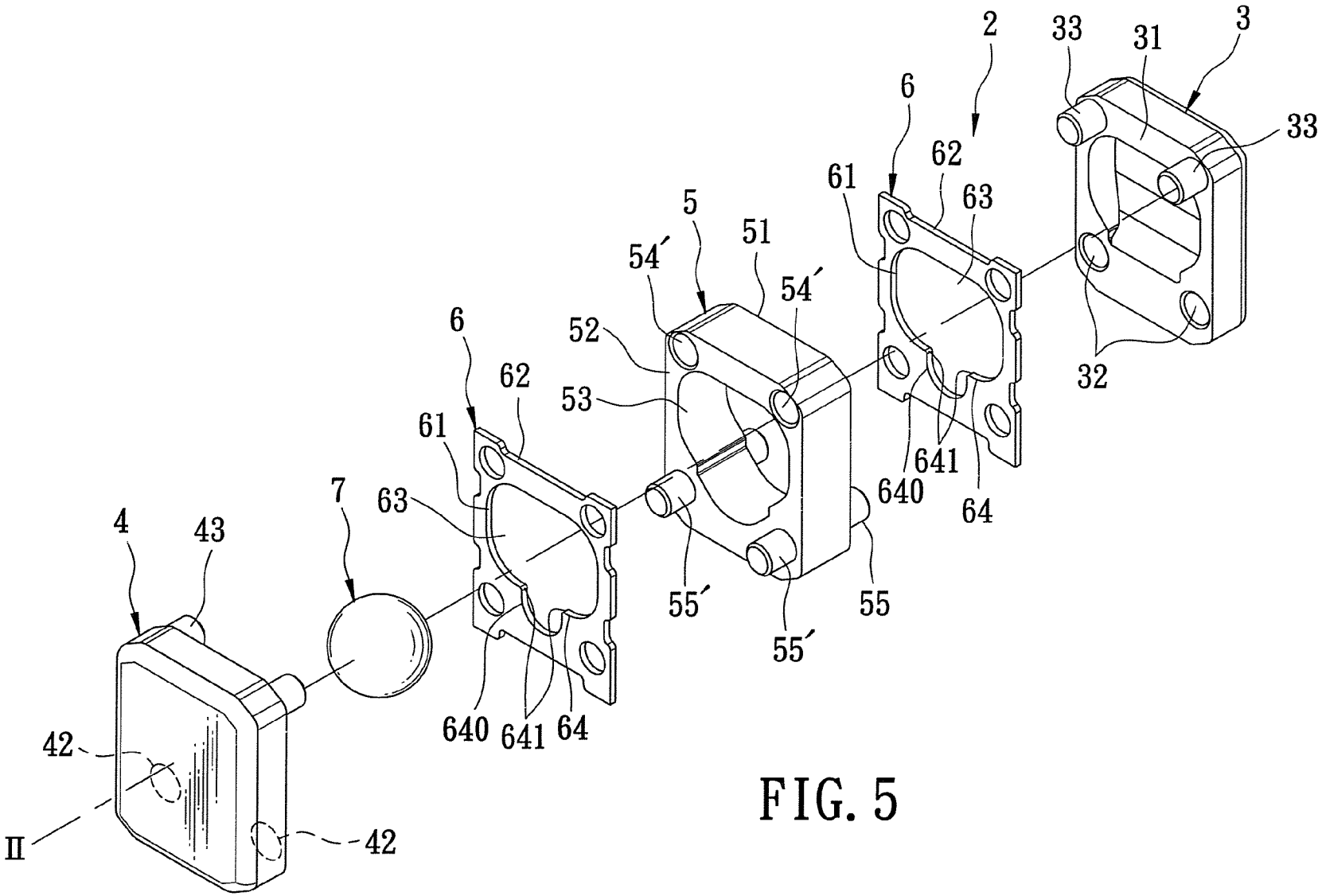
FIG. 5 is an exploded perspective view of the first preferred embodiment.
Figure 12:
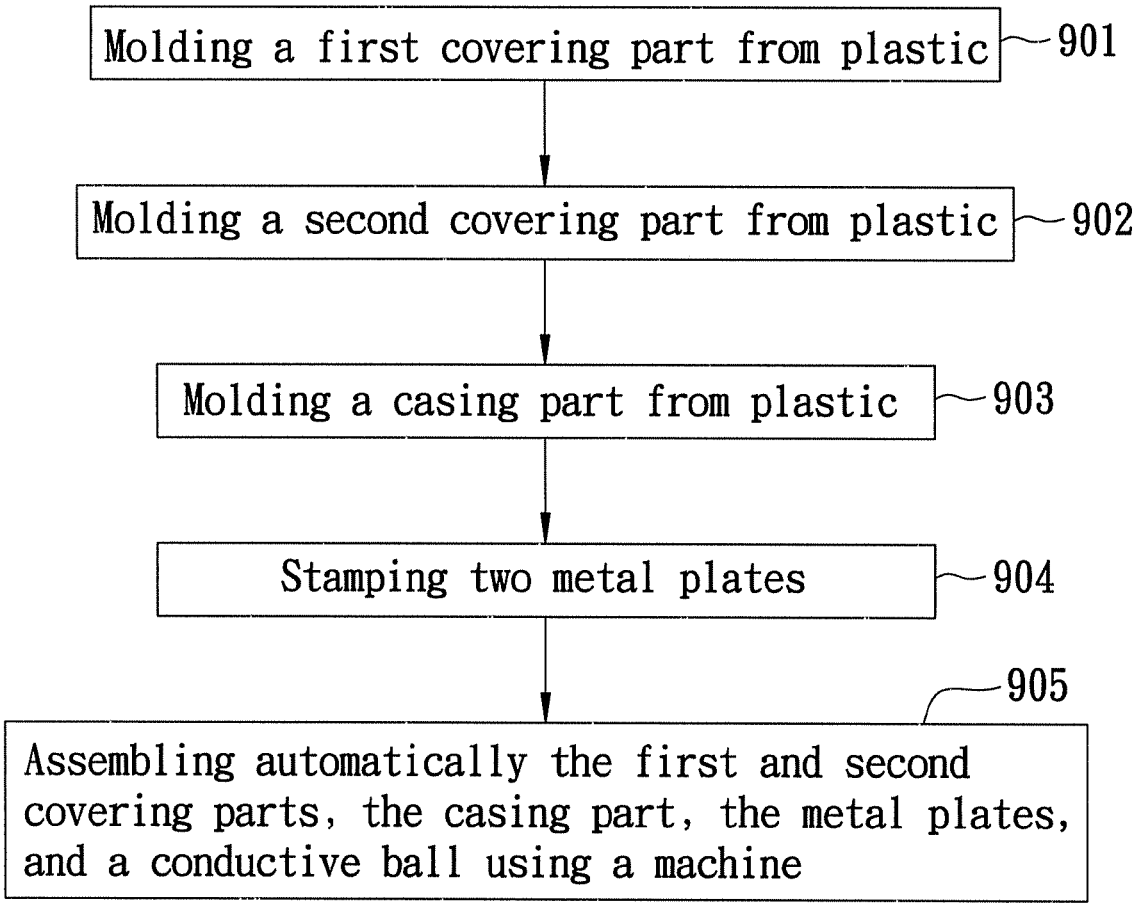
FIG. 12 is a flow chart illustrating the steps involved in making the rolling-ball switch of the present invention.

Referring to FIG. 12, in combination with FIGS. 4 and 5, the steps involved in making the rolling-ball switch 2 of the present invention are shown. These steps will be described in greater detail below.

In step 901, the first covering part 3 is molded from plastic so as to have the first recessed inner side 31, the two third grooves 32, and the two third protrusions In step 902, the second covering part 4 is molded from plastic so as to have the second recessed inner side 41, the two fourth grooves 42, and the two fourth protrusions 43.

In step 903, the casing part 5 is molded from plastic so as to have the intermediate through hole 53, the two first grooves 54, the two second grooves 54', the two first protrusions 55, and the two second protrusions 55'.

In step 904, the two metal plates 6 are formed by stamping so that each metal plate 6 includes the irregular-shaped outer peripheral edge 62, and the inner peripheral edge 61 surrounded by the outer peripheral edge 62 and defining the through hole 63. The inner peripheral edge 61 has the edge portion 64. The edge portion 64 has the notch 640, and the two contact points 641 on two sides of the notch 640. Further, each of the metal plates 6 can be made to include the two conductive legs 65 that project outwardly from the outer peripheral edge 62 of the respective metal plate 6 so as to form the metal plates 6' shown in FIG. 10.

In step 905, the first and second covering parts 3, 4, the casing part 5, the metal plates 6, and the conductive ball 7 are assembled automatically using a machine. The first covering part 3, one of the metal plates 6, the casing part 5, the other metal plate 6, and the second covering part 4 are assembled consecutively and are aligned along an axis (II). At this time, the conductive ball 7 is confined movably within the chamber 8 (see FIG. 6) defined by the first covering part 3, the metal plates 6, the casing part 5, and the second covering part 4. Since automatic assembly using a machine as described above is known in the art, and is not an important aspect of the present invention, a detailed description of the same is dispensed herewith.

Figure 2:
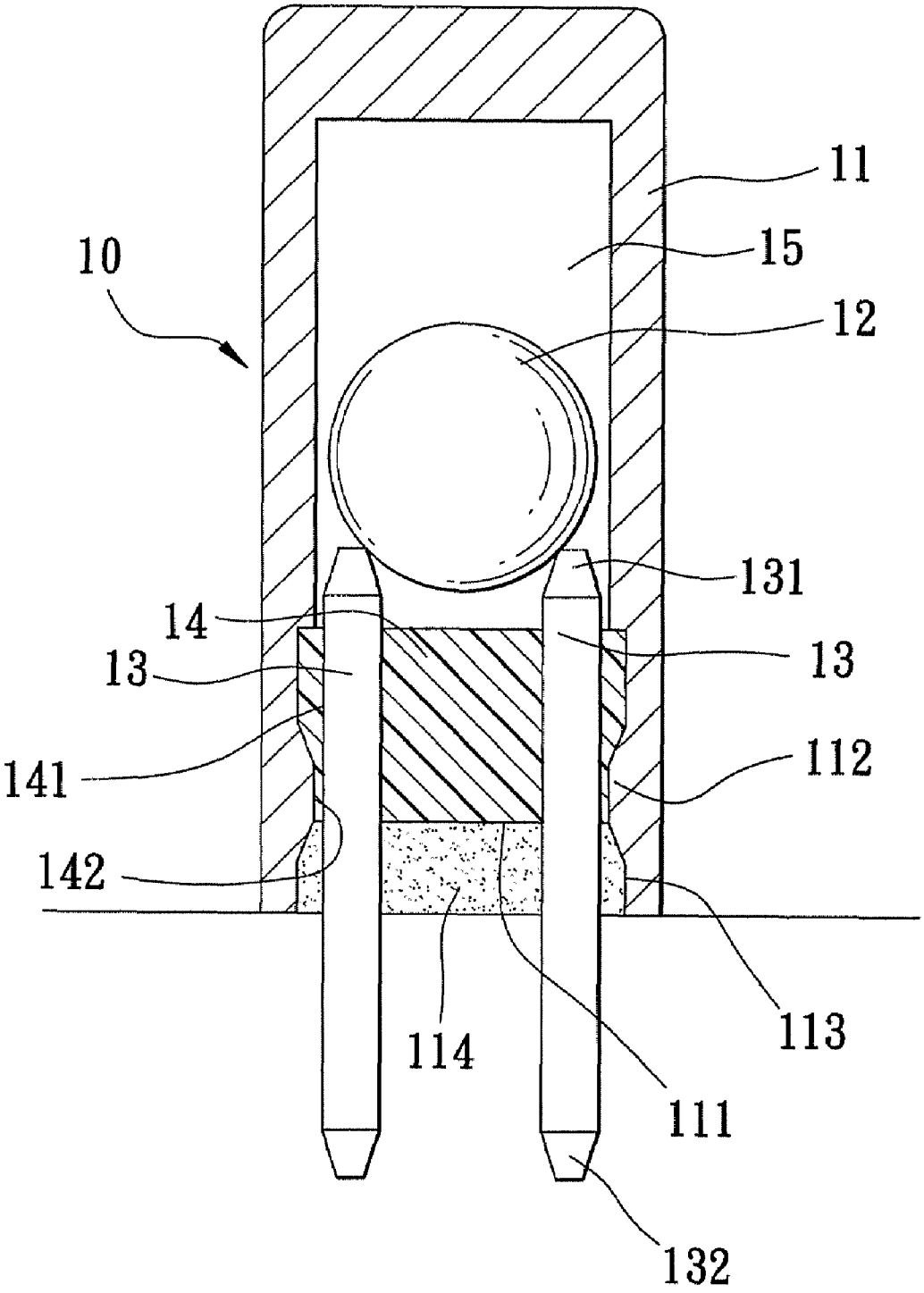
FIG. 2 PRIOR ART
FIG. 2 is an assembled partly sectional view of the conventional rolling-ball switch of FIG. 1.
Figure 3:
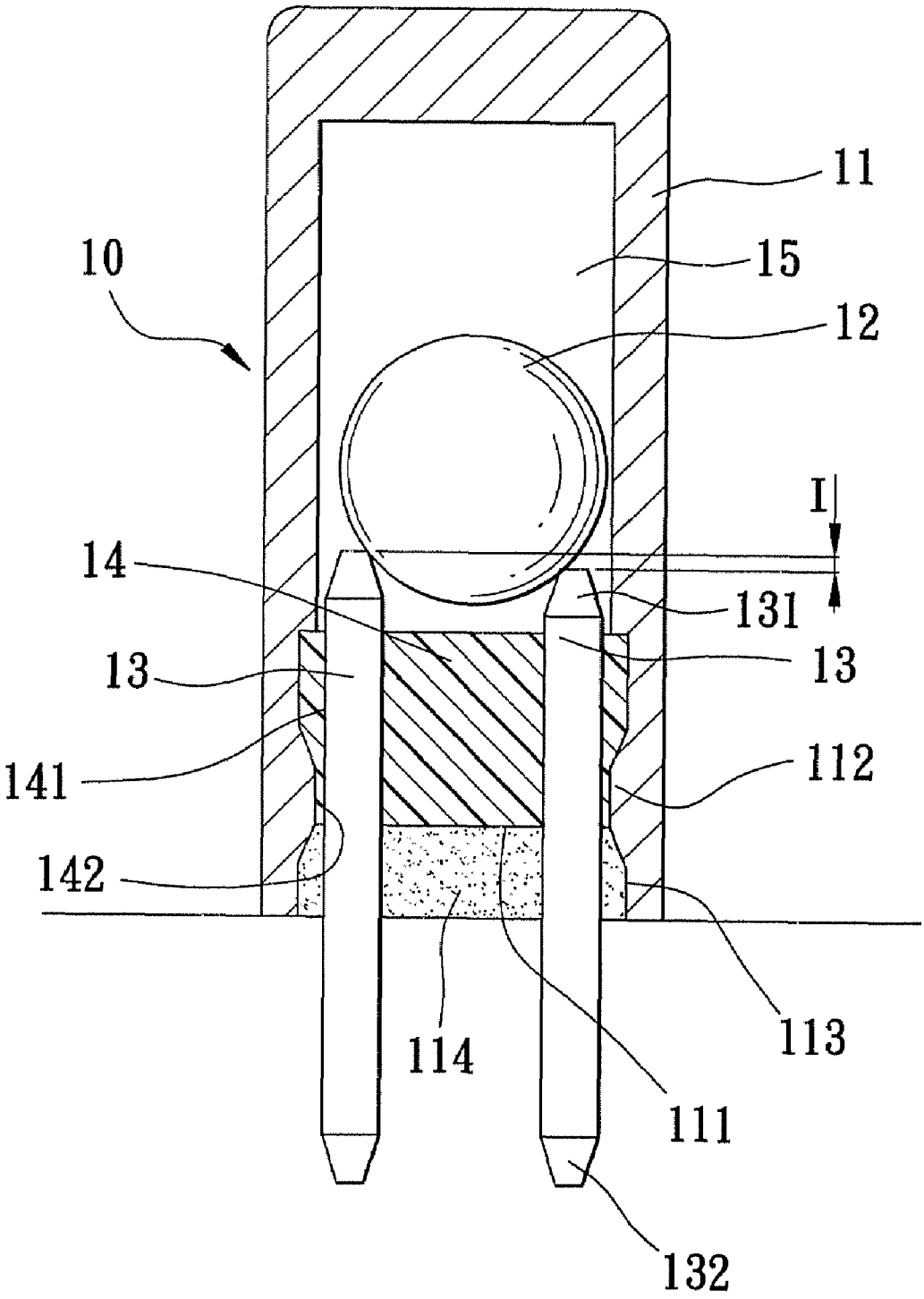
FIG. 3 PRIOR ART
FIG. 3 is a view similar to FIG. 2, but illustrating unequal heights of terminal rods of the conventional rolling-ball switch.

From the aforementioned description, the advantages of the rolling-ball switch 2 of the present invention and the method of making the same can be summarized as follows:

1. The two metal plates 6 that support the conductive ball 7 are stamped together. Compared to the conventional rolling-ball switch 10 shown in FIGS. 1 and 2, the present invention dispenses with the need to assemble individually the four terminal rods 13 on the bottom seat 14 of the conventional rolling-ball switch 10, and dispenses with the need to adjust the heights of the terminal rods 13, so that assembly of the rolling-ball switch 2, 2' of the present invention is simple and time-saving. This is because the third protrusions 33 pass through one of the metal plates 6 and engage the respective first grooves 54, the first protrusions 55 pass through said one of the metal plates 6 and engage the respective third grooves 32, the fourth protrusions 43 pass through the other one of the metal plates 6 and engage the respective second grooves 54', and the second protrusions 55' pass through said other one of the metal plates 6 and engage the respective fourth grooves 42. The metal plates 6 are therefore aligned with and respectively positioned between the first covering part 3 and the first connecting face 51 of the casing part 5 and between the second covering part 4 and the second connecting face 52 of the casing part 5 of the switch 2, 2'.

2. Since the two contact points 641 are formed integrally with the respective metal plate 6, the rolling-ball switch 2, 2' of the present invention is not likely to undergo ON and OFF switching in an unstable manner as in the case of the conventional rolling-ball switch 10.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A rolling-ball switch, comprising:

an insulative casing part including a first connecting face, a second connecting face opposite to said first connecting face, and an intermediate through hole extending from said first connecting face to said second connecting face;

an insulative first covering part having a first recessed inner side covering said first connecting face;

an insulative second covering part having a second recessed inner side covering said second connecting face, said first and second recessed inner sides and said intermediate through hole cooperatively defining a chamber;

two metal plates respectively disposed between said first covering part and said first connecting face and between said second covering part and said second connecting face, each of said metal plates including an outer peripheral edge, and an inner peripheral edge surrounded by said outer peripheral edge and defining a through hole that communicates with said intermediate through hole, said inner peripheral edge having an edge portion projecting into said chamber; and a conductive ball disposed movably in said chamber, and having a diameter larger than a distance between said edge portions of said metal plates so that said conductive ball can bridge said edge portions of said metal plates to place said rolling-ball switch in an ON state.

2. The rolling-ball switch of claim 1, wherein said edge portion of each of said metal plates has a notch, and two contact points on two sides of said notch to contact said conductive ball.

3. The rolling-ball switch of claim 1, wherein said casing part further includes at least one protrusion projecting outwardly and axially from said first connecting face, said first covering part having at least one groove engaged to said protrusion.

4. The rolling-ball switch of claim 1, wherein said casing part further includes at least one groove provided in said first connecting face, said first covering part having at least one protrusion engaged to said groove in said first connecting face.

5. The rolling-ball switch of claim 1, wherein said casing part further includes at least one protrusion projecting outwardly and axially from said second connecting face, said second covering part having at least one groove engaged to said protrusion on said second connecting face.

6. The rolling-ball switch of claim 1, wherein said casing part further includes at least one groove provided in said second connecting face, said second covering part having at least one protrusion engaged to said groove in said second connecting face.

7. The rolling-ball switch of claim 1, wherein each of said metal plates further includes at least one conductive leg projecting outwardly from said outer peripheral edge thereof.

8. A method for making the rolling-ball switch of claim 1, comprising:

(A) molding a first covering part from plastic;

(B) molding a second covering part from plastic;

(C) molding a casing part from plastic;

(D) stamping two metal plates each having a through hole; and (E) assembling automatically the first and second covering parts, the casing part, the metal plates, and a conductive ball using a machine in such a manner that the first covering part, one of the metal plates, the casing part, the other one of the metal plates, and the second covering part are assembled consecutively and are aligned with each other along an axis, said conductive ball being confined within a chamber defined by the first covering part, the casing part, and the second covering part.

* * * * *